US005992651A

United States Patent [19]

Shaw et al.

[11] Patent Number: 5,992,651

[45] Date of Patent: Nov. 30, 1999

[54] GRAVITY FLOW RACK HAVING PRODUCT DISPLAY SEAT

[75] Inventors: Kenneth A. Shaw, Lombard; Henry J. Massett, Evergreen Park, both of Ill.

[73] Assignee: B-O-F Corporation, Aurora, Ill.

[21] Appl. No.: 09/071,448

[22] Filed: May 1, 1998

[51] Int. Cl.[6] ..... A47F 1/04

[52] U.S. Cl. ..... 211/59.2

[58] Field of Search ..... 211/59.2, 74, 106, 211/59.3, 181.1

[56] References Cited

U.S. PATENT DOCUMENTS

| | | | |
|---|---|---|---|
| 1,524,748 | 2/1925 | O'Connor . | |
| 2,013,284 | 9/1935 | Michaud . | |
| 2,176,384 | 10/1939 | Varney . | |
| 2,289,751 | 7/1942 | Brenholt . | |
| 3,203,554 | 8/1965 | Pendergrast, Jr. et al. | 211/59.2 |
| 3,805,964 | 4/1974 | Titus, Jr. | 211/59.2 |
| 3,900,112 | 8/1975 | Azzi et al. . | |
| 4,015,885 | 4/1977 | Baggaley | 211/59.2 |
| 4,205,763 | 6/1980 | Merl . | |
| 4,479,583 | 10/1984 | Franklin et al. . | |
| 4,732,282 | 3/1988 | Lockwood . | |
| 5,115,920 | 5/1992 | Tipton et al. . | |
| 5,607,068 | 3/1997 | Coretti, Jr. et al. . | |

OTHER PUBLICATIONS

Brochure—"Gravity Flow Shelving," Milk Moover®, Nyla– Track II, 1990, B–O–F Corporation, Lombard, IL.

"SLIP" Self–Facing Ice Cream Display Shelving Brochure, Cannon Equipment Company, Cannon Falls, Minnesota. Understood to be available since May, 1995.

*Primary Examiner*—Alvin Chin-Shue
*Assistant Examiner*—Sarah Purol
*Attorney, Agent, or Firm*—Tilton, Fallon, Lungmus & Chestnut

[57] ABSTRACT

A gravity flow rack system specifically designed for use in dispensers of cylindrical- or conical-shaped lightweight plastic containers such as disposable yogurt tubs has inclined shelves supporting container flow channels, each of such channels defined by a pair of elongated rails extending from a rear end to a forward lower end of the shelf and terminating at an L-shaped seat or cradle adapted to receive a lower-most of such containers as it reaches the forward end of the channel, and present that lower-most container in an inviting, easy-to-view, label-up orientation for consumer viewing, while remaining containers stacked upstream of the lower-most container in the same channel are generally obscured from view in order to deter inventory mishandling.

22 Claims, 2 Drawing Sheets

FIG. 4
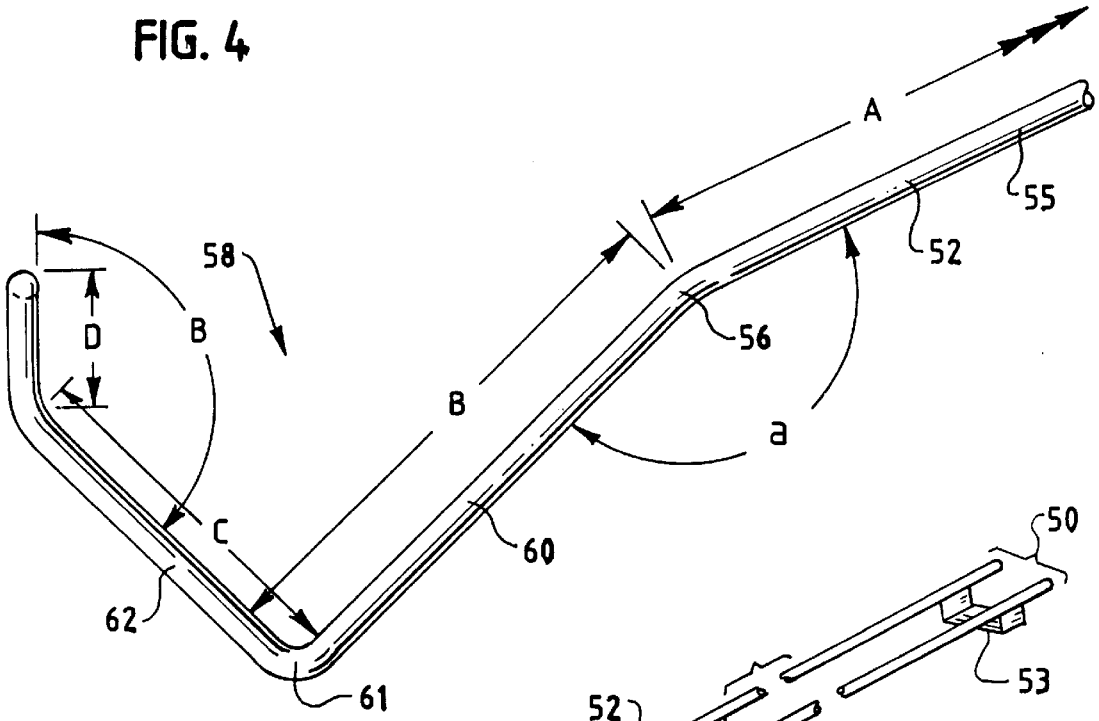
FIG. 5
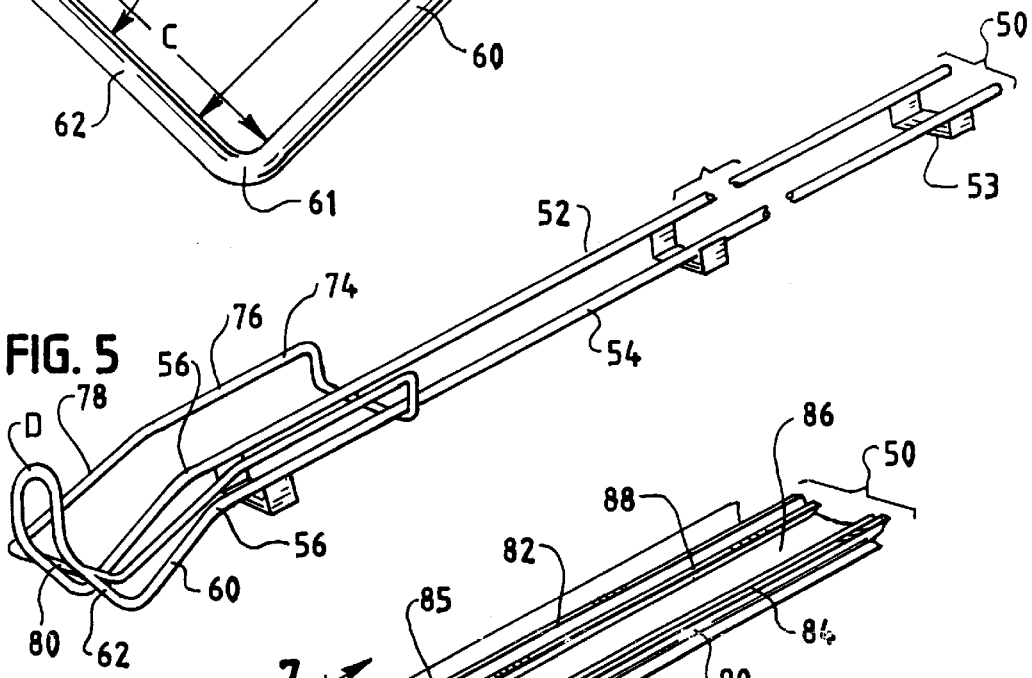
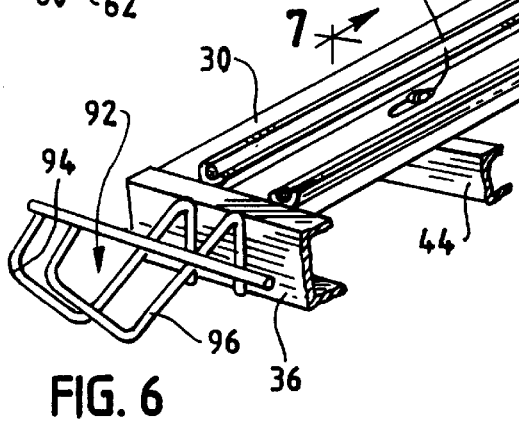
FIG. 6
FIG. 7
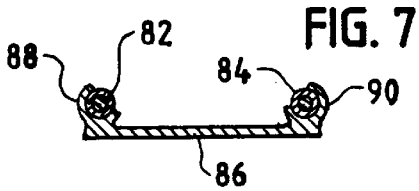
FIG. 8
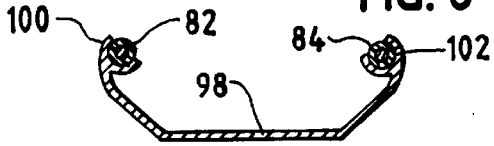

GRAVITY FLOW RACK HAVING PRODUCT DISPLAY SEAT

BACKGROUND

1. Field of the Invention

This invention relates generally to shelving systems and, more specifically, to gravity flow racks for use in refrigerated dispensers of generally cylindrical- or conical-shaped individual food containers such as disposable yogurt containers.

2. Description of the Prior Art

The competing interests of grocers and other retailers in keeping high inventory turnover and consumers in buying the freshest food products available is particularly evident in the refrigerated dairy product aisle of many grocery or convenience stores. Try as grocers may to put older products toward the front of the shelf and newer products toward the rear, consumers invariably rummage through the refrigerated merchandise until they reach the rear of the shelf looking for food package containers bearing later expiration dates. The problem is particularly pervasive with respect to disposable single-serving-size yogurt containers. Such package containers, typically formed as plastic tubs with a relatively slippery surface, have generally cylindrical or conical shapes. This makes the package containers difficult to vertically stack and, when they are so stacked, easy to topple over. They generally have a freshness date or a so-called "sell by" or "age" date stamped in a location that is hidden from view when such containers are stacked, such as on the product's lid.

Consumers have a tendency to disorganize dispenser shelving, and the pre-organized food container arrays on such shelving, to make newer product easier to reach. Furthermore, when restocking conventional, front-loaded flat refrigerated shelves with new product, it is easier for employees to push older product toward the rear of the shelf to make room for new product than it is to properly re-stock the shelf in a manner that keeps the older inventory closest to the consumer, i.e. towards the front of the shelf. Also, such consumer-generated relocation of food containers requires regular re-shelving and reorganizing of such containers, i.e. excessive labor requirements for grocers. All these practices result in less than optimal inventory turnover to the grocers, who are often left with product that remains unsold past its expiration date.

It would therefore be desirable to have a shelving system for use in refrigerated merchandise dispenser units that could organize and maintain individual product containers by date, so that the first product placed into the dispenser is the first product selected by the consumers for purchase, i.e. first-in, first-out.

The use of gravity flow shelving systems to achieve such a first-in, first-out dispenser has been well-known for shelving of large packages found in warehouses, as disclosed in Tipton et al., U.S. Pat. No. 5,115,920, and even for dispensers of smaller consumer items, such as lip gloss, aspirin bottles, soda cans and milk bottles. For example, Merl, U.S. Pat. No. 4,205,763 and Lockwood, U.S. Pat. No. 4,732,282 disclose gravity flow systems directed for such products.

In addition, Coretti, Jr. et al., U.S. Pat. No. 5,607,068, owned by B-O-F Corporation of Aurora, Ill., the assignee of the present invention, discloses a wire mesh gravity flow shelving system marketed under the trademark Milk Moover®, which is well-suited for a variety of sizes and shapes of milk containers and is specifically adapted for use in refrigerated dispenser units. The cartons of milk to be dispensed contact the wire mesh shelves at multiple, i.e. more than two, points along the bottoms of the cartons because the carton makes contact with each of the closely-spaced wires of the shelf that are underneath the carton. Such multiple contact points add friction, which can impede the flow of lighter containers, such as disposable yogurt tub containers, to be dispensed on the shelf.

When directed to such cylindrical- or conical-shaped food product containers, such prior art dispensers suffer from several shortcomings. For example, many depend on the use of a stop in the form a reciprocating stage (as in the Tipton et al. patent), a trip wire (as in the Lockwood patent), or swiveling means taking the form of a diverging curved end wall (as in the Merl patent) to interrupt the gravitational movement of the product being dispensed before the lowermost product is placed in a position for display. In other words, such prior art gravity flow racks lack a design that integrally controls the capture and positioning of the lowest container when it reaches the bottom of the shelf. Such integral control is particularly desirable for products packaged in small, slippery, substantially cylindrical or conical containers, e.g. individual serving plastic yogurt tubs, as these containers have a tendency to topple over easily. If such methods as a trip wire or diverging end wall were used to interrupt the path of these small, odd-shaped plastic tubs in a gravity flow rack system, it would be difficult to predict or rely upon consistent placement of the tubs in a "label-up" display position within a dispenser. Typically, one container might slip over another, and become misaligned in an overall end-to-end array of stacked containers. In a worst case, an entire shelf of food containers could spill onto the floor of the dispenser unit or into a store aisle as successive containers keep toppling over the lower edge of the shelf. Such an unpredictable result is unacceptable.

Several of the gravity flow shelving systems of the prior art utilize inclined roller bearings, inclined smooth flat surfaces, or inclined bent wire frames having closely-spaced wire tracks present to facilitate sliding forward movement of containers stored on the shelves until the containers are tightly stacked against a lower-most container at the front of the dispenser shelf (such as for canned food product, and soft drink cans). However, all of such conventional surfaces are inadequate for reliably controlling the flow and label-up display of slippery, relatively unstable, odd-shaped cylindrical or conical food containers. By "label-up", what is meant is that the consumer product information, such as brand-name, flavor, and ingredients, is presented in a consumer-friendly fashion so that the front of the container bearing such labeling faces the consumer standing in front of the display unit. This is particularly true when the containers need to be stacked in an end-to-end array, that is—top-to-bottom in a manner that simultaneously maximizes storage capacity of the shelving system and discourages consumers from manipulating the position of the containers stacked higher than the lower-most container, e.g. for purposes of finding product bearing a later expiration date than the lower-most container.

A further drawback to the conventional gravity flow systems is cost. Material and manufacturing costs for roller bearing surfaces, low-friction flat surfaces, or even closely-spaced wire mesh-type rack shelving are high compared to the various embodiments of the improved gravity flow system of the present invention. Thus, by using a minimal amount of materials, small cylindrical or conical-shaped packages can be more easily stored on shelving and significant savings in materials and manufacturing costs can be achieved, as compared to the gravity flow systems found in the prior art.

The manner in which the present invention overcomes these and other shortcomings of conventional gravity flow systems for use in dispensing cylindrical or conical-shaped packages such as plastic yogurt containers is explained in the following Summary of the Invention, the Drawings, and the Detailed Description of the Preferred Embodiments.

SUMMARY OF THE INVENTION

According to a first embodiment of the present invention, the efficient storage of multiple cylindrical or conical shaped containers is achieved by a gravity flow shelving unit having a strong heavy-duty metal rack unit, preferably wheeled, with inclined shelves formed of metal frames. Multiple pairs of spaced-apart, longitudinally-oriented, inclined rails defining container flow channels extend from the rear to the front of each inclined shelf. The rails of each pair are advantageously spaced apart from one another a sufficient distance to ensure controlled movement of the slippery, odd-shaped containers as they travel downward as an end-to-end linear array of containers toward the front of the container flow channel. The pairs of rails are preferably spaced a sufficient distance from one another to allow small, odd-shaped plastic tub containers to be stored in, and to advance down, each of the channels with a minimum of contact with the containers, without interfering with containers in adjacent channels, and also without disorienting the next adjacent tub containers (upstream or downstream) in that channel. By way of example only, one suitable set of dimensions for such a gravity flow rack is for the rails of each pair to be spaced about 1 1/16" apart from one another, and the adjacent pairs of rails to be spaced a distance of about 2 15/16" from one another.

At the lower-most end of the shelf, each pair of rails bends downwardly at a shoulder portion of each rail and forms a substantially L-shaped seat or cradle. The L-shaped seat at the bottom of each container flow channel supports and prominently displays a lower-most plastic tub container, in a proper label-up visual display, at the front end of that given shelf of the gravity flow shelving unit. Advantageously, the lower-most container falls into the seat after sliding past the front end of the shelf frame, and stops at the end of the channel defined by the bottom of the L-shaped seat, which extends substantially perpendicularly from the back of the L-shaped seat. Once stationary in the L-shaped seat, the top of the lower-most container forms an angled stop wall which abuts the bottom of the next-higher container, thus preventing downward movement of the remaining containers stacked in the same container flow channel.

The position of the lower-most container in the L-shaped seat provides consumers with optimal viewing area so expiration date information, ingredients, product brand name, and flavor labeling can be easily read on that container. However, most of such information on the remaining successive containers stacked in the container flow channel remains obscured from view, and generally out of reach. Because of the present invention's specific style of gravity flow shelving, all the remaining containers in a given container flow channel advance forward with their labels and expiration date information generally obscured when the lower-most container is removed from the L-shaped seat. This discourages consumers from looking upstream, i.e. looking at higher stacked containers in a given channel, for products bearing later expiration dates. The present invention also facilitates higher inventory turnover, as well as more organized and more densely packed dispenser displays, and less overall required inventory maintenance (i.e. less labor costs), and less refrigerated display case space as compared to prior art gravity flow shelving systems.

The shoulders of the rails preferably form an angle "a" in a range of about 150°–170°, and most preferably about 160°, with the inclined plane defined by the shelf frame and the rails. In this fashion, the lower-most plastic tub container seated in the L-shaped seat faces the consumer in a label-up manner inviting easy removal from the dispenser unit. Each pair of inclined rails terminates at a U-shaped tongue portion extending substantially vertically upward from the bottom of the L-shaped seat. To provide further reinforcement to the rails, and as an extra precaution against unwanted lateral movement of the stacked containers, a shelf perimeter guard rail is provided which extends outwardly from preferably only the left-most and right-most rails, above and substantially parallel to the inclined container flow channels, and across the bottoms of the L-shaped seats. In addition to the shelf perimeter guard rail, which forms a perimeter above the lower forward end of the inclined shelf frame, channel separators in the form of raised rails that are resiliently biased to the shelf frame by first and second frame attachment means are installed in between the adjacent pairs of rails.

In a first alternate embodiment of the present invention, instead of only an outer shelf perimeter guard rail, there is present, for each container flow channel on a shelf, a substantially U-shaped seat perimeter guard rail. Such seat perimeter guard rails extend outwardly from each of the pair of rails, above and substantially parallel to the inclined container flow channel defined by the pair of rails, and across the bottom of the L-shaped seat. The seat perimeter guard rails act to further prevent and ensure against unwanted lateral movement of at least the lower-most container seated in the L-shaped seat. Depending on how far the seat perimeter guard rails extend up each pair of rails, lateral movement of one or more additional stacked containers can also be prevented. If desired, channel separators may also be used in between adjacent pairs of rails in this first alternate embodiment.

In a second alternate embodiment of the present invention, instead of pairs of inclined rails of the form disclosed in either embodiment discussed above, each container flow channel is defined by a pair of low-friction nylon tubes or slide guides that are supported in inclined metal tracks secured to the refrigerator shelf frame. Each metal track has a pair of opposing slide guide supports that are substantially C-shaped in cross-section and preferably extend the length of the metal track.

At the front or lower-most end of such a modified flow channel track, instead of a continuous rail extending over a shoulder and into an L-shaped seat, a separate but similarly-shaped cradle is provided to catch and provide prominent label-up display of the lower-most container. The orientation of the nylon slide guides to the cradle is preferably about 160°, and the remaining stacked containers are held in place upstream by the lower-most container seated in the cradle, as in the previous embodiments.

In order to customize the shelf system of the second alternate embodiment to accommodate product containers of different sizes or circumferences, the metal track can be made in a variety of widths and depths so that the C-shaped slide guide supports, and thus the nylon slide guides which are seated therein, are appropriately spaced for the given product container requirements. For example, the metal track can have a shallow depth, e.g. 1/8", and a relatively narrow span between the C-shaped slide guide supports, e.g. 1½", for gravity flow shelving of smaller plastic tub containers, or the metal track can be formed deep, e.g. with a maximum depth of 5/8" and having an open generally U or V-shape, and with a relatively wider span between the C-shaped slide guide supports, e.g. 1⅞", to accommodate larger sized plastic tub-type containers.

While it will be understood by those of ordinary skill in the art that the embodiments of the present invention are particularly suited for use in refrigerated food container dispenser units, the teachings of the present invention are not intended to be limited thereto, and the gravity flow shelving of the present invention can also be used in other applications where controlled storage and dispensing of generally odd-shaped cylindrical or conical containers is desired.

DESCRIPTION OF THE DRAWINGS

FIG. 4 is a right side view, broken away, of the L-shaped seat or cradle at the lower end of a container flow channel of the gravity flow rack shown in FIG. 1;

FIG. 5 is a perspective view of a container flow channel made according to a first alternate embodiment of the present invention;

FIG. 6 is a perspective view of a container flow channel made according to a second alternate embodiment of the gravity flow rack of the present invention in which low-friction nylon slide guides are provided in a track to facilitate movement of containers along the inclined shelf;

FIG. 7 is a cross-sectional view, taken along lines 7—7 of FIG. 6, of the second alternate embodiment of the gravity flow rack, showing a shallow track for use with relatively small-sized containers; and FIG. 8 is a cross-sectional view of the second alternate embodiment of the gravity flow rack similar to FIG. 7, modified to show a wider and deeper track than that shown in FIG. 7 for use with relatively larger-sized containers.

DETAILED DESCRIPTION OF THE PREFERRED EMBODIMENTS

Figure 1:
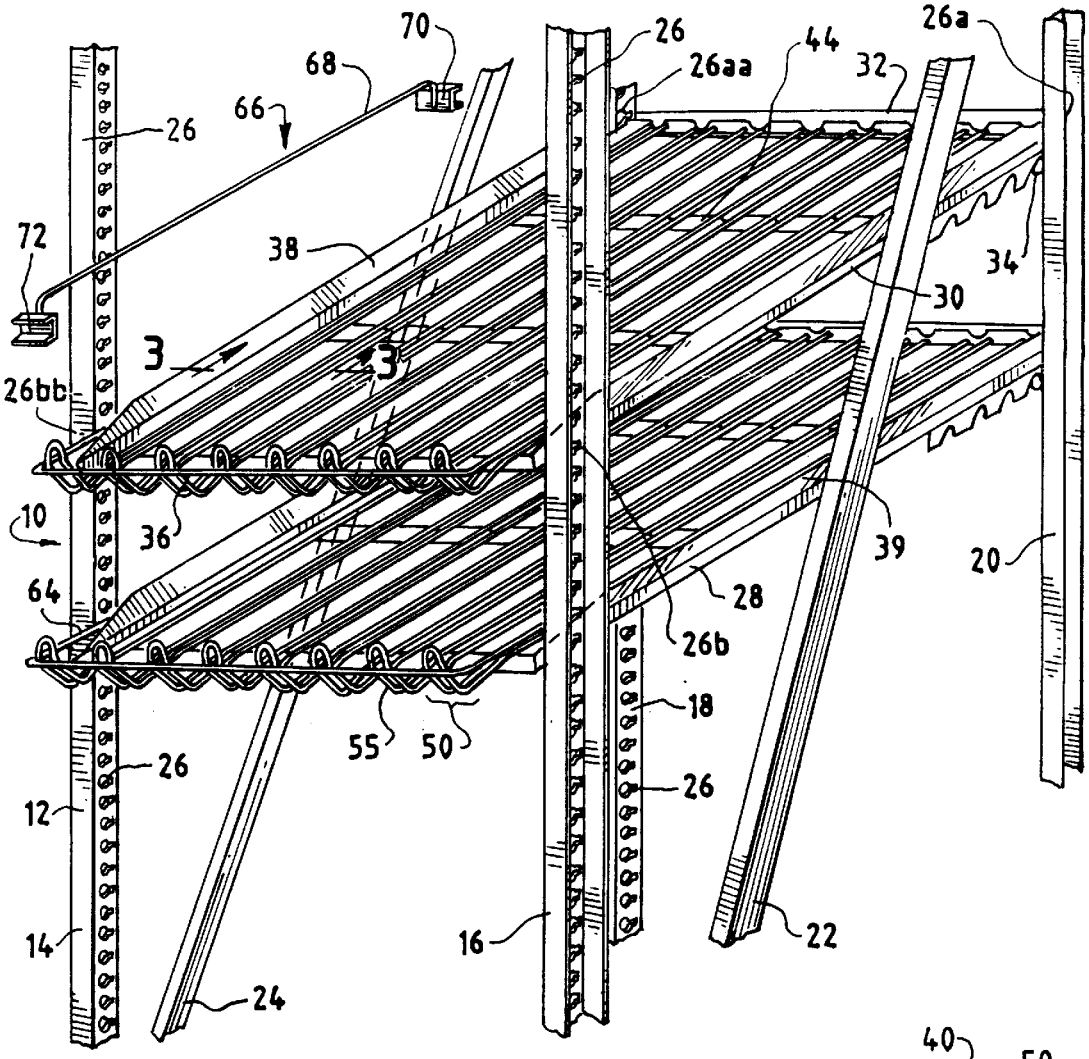
FIG. 1 is a perspective view of a gravity flow rack according to the most preferred embodiment of the present invention.

Referring to FIGS. 1–4, the preferred embodiment of the present invention takes the form of a gravity flow rack system generally denoted as reference number 10. The gravity flow rack system 10 includes a sturdy, preferably heavy-duty metal, rectangular shelf frame 12 having front vertical legs 14, 16 and rear vertical legs 18, 20. The rectangular shelf frame 12 may further be provided with diagonal stabilizer support members 22, 24. To customize assembly of the gravity flow rack system 10, each of the legs 14, 16, 18, 20 is provided with holes 26 along its length so that inclined shelf frames 28, 30 may be placed at any desired height and angle of incline along the legs 14, 16, 18, 20 so as to maximize storage capacity. For example, the top shelf frame 30 is mounted such that an upper rear end 32 of the inclined shelf frame 30 is supported by suitable support means 34, such as a pair of flanges, bolts, or studs mounted in a pair of parallel holes 26*a*, 26*aa* along rear vertical legs 18, 20. A lower forward end 36 of the shelf frame 30 is similarly supported by support means mounted in a pair of parallel holes 26*b*, 26*bb* along front vertical legs 14, 16 which holes 26*b*, 26*bb* are lower than holes 26*a*, 26*aa*.

Figure 2:
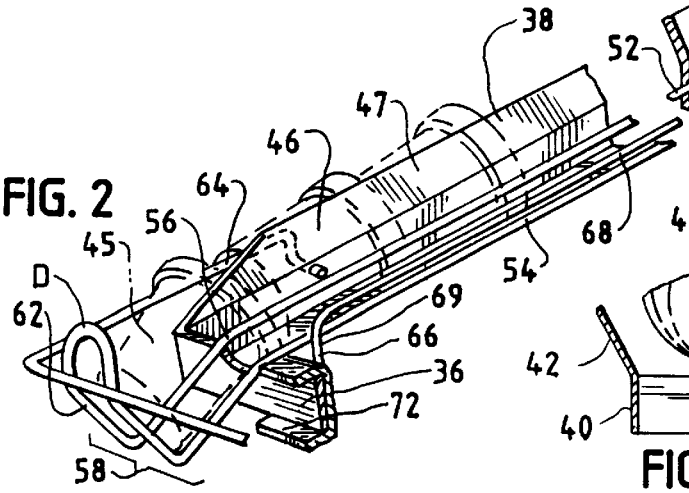
FIG. 2 is an enlarged perspective view, broken away, of a left-most container flow channel on an inclined shelf frame of the gravity flow rack shown in FIG. 1.
Figure 3:
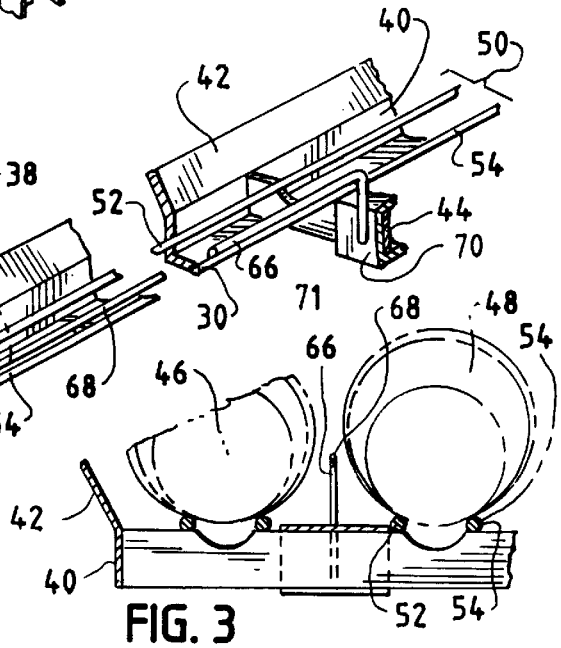
FIG. 3 is a cross-sectional view taken along lines 3—3 of FIG. 1 showing two adjacent container flow channels having a channel separator therebetween.

Each of the inclined shelf frames 28, 30 is further provided with a left side wall 38 and a right side wall 39, each of the side walls 38, 39 having a vertical lower portion 40 and an outwardly angled upper wing portion 42, as best shown in FIGS. 2 and 3. The angled upper wing portion 42 serves to prevent outward lateral movement of containers in the left-most or right-most container flow channels, thus preventing containers from falling over the sides of the gravity flow rack system 10. The shelf frame 30 also includes horizontal cross support members 44.

Advantageously, cylindrical or conical-shaped containers 46, 47, 48, (shown in broken lines for purposes of clarity) such as disposable, relatively slippery-surfaced, specially configured plastic yogurt tubs, can be conveniently and generally horizontally stocked (i.e. on their backs in an end-to-end array of the containers) in the gravity flow rack system 10 by means of multiple rear-loaded container flow channels 50. Each container flow channel 50 is defined by a pair of inclined spaced rails 52, 54 that extend from the rear end 32 of the shelf frame 30 down to and past the lower forward end 36 of the shelf frame 30, i.e. so as to provide a front consumer display end. It will be understood by those of ordinary skill in the art that each pair of rails 52, 54 may be, in the most preferred form, made of a single, continuous metallic rail 55 bent into an appropriate shape as will be explained in more detail below, or alternatively, formed of two separate parallel rails.

For aesthetic and practical considerations, the rails 52, 54 also preferably include a non-stick, easy-to-clean coating, such as a high gloss epoxy coating which is available from Morton Powder Coatings, Inc. of Reading, Pa. Rails 52, 54 preferably have a diameter of about 3/16". Also, the rails 52, 54 are preferably spaced far enough apart to facilitate controlled movement of tub containers 46, 47 down the container flow channel 50. Importantly, if the rails 52, 54 are spaced too closely to one another, as in the wire mesh shelving found in the prior art, then the generally unstable food containers 46, 47 will have a greater tendency to topple over and fall out of the channel 50, or otherwise become misaligned. By way of example, a suitable distance between the rails 52, 54 is in a range of about is 1 1/16" to about 2 3/16", when used with a yogurt-type plastic tub container of a generally conical shape, having an upper end of approximately 2"–5" in diameter, a lower end of approximately 2"–4" in diameter, and a height of approximately 2"–5". The exemplary dimensions used herein provide that the rails 52, 54 are adequately spaced apart from one another such that each tub container is retained within a container flow channel 50 by the weight of the container. This arrangement also benefits from lower friction because by having each container touching only two rails, there are reduced points of contact between the relatively light-weight product containers and the container flow channels 50. Each pair of rails 52, 54 is mounted on the inclined shelf frame 30 by suitable rail support means, such as several U-shaped brackets 53 (shown in FIG. 5, but omitted from FIGS. 1–4 for clarity) which can be bolted, welded, or otherwise fastened to the shelf frame's horizontal cross support members 44.

Adjacent pairs of rails 52, 54 are preferably spaced sufficiently apart from one another so that tub containers 46, 47 in a first container flow channel 50 do not interfere with other adjacent tub containers, such as container 48 in the next-adjacent container flow channel. By way of example, a suitable distance between adjacent pairs of rails 52, 54 is about 2 15/16".

Just above the lower forward end 36 of the shelf frame 30, each of the rails 52, 54 has a bent shoulder section 56. As shown in FIG. 4, shoulder 56 forms an angle "a" in a range of about 150° to about 170°, and preferably of about 160°, between the portion A of the rail 52 that is parallel to the inclined shelf frame 30, and the portion B of the rail 52 which forms the back 60 of a cradle in the shape of a substantially L-shaped seat 58. The L-shaped seat 58 also has a portion C defining a bottom 62 of the cradle.

Advantageously, the L-shaped seat 58 retains the lower-most tub container 45 in an easy-to-view, label-up position, so consumers can read the expiration date, product brand, ingredients, flavor, or other label information on that lowermost container 45. However, such consumer information on the remaining stacked containers 46, 47 located upstream in the same flow channel 50 is generally obscured from view, and such upstream containers are general out of reach of consumers. This orientation of the lower-most container 45, versus the other containers 46, 47 upstream in the same container flow channel 50, helps deter consumers from tampering with the product containers in the gravity flow dispenser shelf system, i.e. from trying to locate packages having later expiration dates. This helps improve overall inventory turnover of such product stocked in the dispenser, and minimizes waste due to expired product.

Other advantages of the preferred angle of orientation of the L-shaped seat 58 relative to the inclined flow channel 50 are that the lower-most container 45 is in an inviting, clearly visible, label-up location for consumers to purchase the lower-most container first. Further, immediately after the lower-most container 45 is removed from the L-shaped seat 58, the next-higher consecutive stacked container 46 immediately drops down to replace it in the L-shaped seat 58, again in an inviting label-up display position, with container 46 then becoming the stop that abuts the bottom of the next-higher container at an angle to prevent further downward motion of the remaining upstream containers. Importantly, due to the present invention's design, there is no need for additional means to disrupt the downward flow of containers before they enter the L-shaped seat 58, as were needed in the gravity flow racks found in the prior art.

The L-shaped seat 58 terminates at a substantially vertical portion D, which makes an angle β with the bottom 62 of the L-shaped seat. The portion B (or back 60) and the portion C (or bottom 62) of the L-shaped seat 58 are substantially at a right angle to one another, meeting at an elbow 61. The vertical portion D, when viewed from the front of the flow channel 50, has an inverted U-shape. It should be understood that the rails 52, 54 are shown in this preferred embodiment to be extensions of a single rail 55, which is bent into two parallel-running halves represented by rails 52, 54. To provide reinforcement to the L-shaped seats, and as an extra precaution against unwanted lateral movement of at least the outer-most and lower-most stacked containers 45, the shelf frame 30 is provided with a shelf perimeter guard rail 64.

A shelf perimeter guard rail 64 extends outwardly from the is rail 52 immediately adjacent the left-most side wall 38, and also from the rail 54 immediately adjacent the right-most side wall 39, both being above and substantially parallel to the rail portions A along the inclined container flow channels 50, and across the bottoms 62 of the L-shaped seats 58. The shelf perimeter guard rail 64 and the upper winged portion 42 of the side walls 38, 39 prevent the outermost containers 45, 46, 47 from falling over the left or right sides of the shelf frame 30.

To provide additional protection against lateral movement of containers in any of the container flow channels 50, additional upstanding channel separators 66 may be inserted between each adjacent pair of rails 52, 54. Each channel separator 66 has a raised rail 68 having first and second legs 69, 71 extending downward at substantially right angles from the raised rail 68. Each channel separator 66 is resiliently biased to the shelf frame 30 by first and second frame attachment means 70, 72. Frame attachment means 70, 72 are each arcuate or C-shaped clasps for securing the first and second legs 69, 71 of the raised rail 68 to a horizontal cross member 44 of the shelf frame 30. The frame attachment means 70, 72 cooperate with one another to resiliently bias the channel separator 66 between a pair of the horizontal cross support members 44, one of such cross members in the preferred embodiment being the lower front end 36 of the shelf frame 30. As indicated by the arrows in FIG. 1, the channel separator 66 is inserted by squeezing the attachment means 70, 72 inwardly and pushing downwardly until the channel separator 66 resiliently locks into position between, for example, the lower front end 36 and the horizontal cross member 44.

Referring now to FIG. 5, a first alternate embodiment of the present invention has a substantially U-shaped seat perimeter guard rail 74 at the lower forward end of each pair of rails 52, 54, instead of only the shelf perimeter guard rail 64. The seat perimeter guard rail 74 is essentially a rail extending outward from each of the rails 52, 54, and upwardly a short distance above the inclined plane defined by the rails 52, 54, and then parallel to the container flow channel 50 along an upper portion 76. The seat perimeter guard rail 74 bends downward toward the bottom 62 of the L-shaped seat 58 above the shoulders 56 of the rails 52, 54, runs parallel to the back 60 along a lower portion 78, and terminates along the bottom 62 of the L-shaped seat 58 along a stop rail 80.

The seat perimeter guard rails 74 prevent excessive lateral movement of at least the lower-most container 45 in each container flow channel 50, thus preventing the containers 45, in the event they are somehow misaligned, from toppling over onto the floor. It will be recognized by those of ordinary skill in the art that, depending on the length of the upper portion 76, the seat perimeter guard rails 74 could be used to prevent lateral movement of one or more additional containers 46, 47 stacked above the lower-most container 45. Also, upstanding channel separators 66 may be used between the container flow channels 50, as in the previous embodiment.

Turning now to FIGS. 6 and 7, a second alternate embodiment of the present invention uses rails that are in the form of low-friction nylon tubes or slide guides 82, 84 to define the container flow channel 50. The slide guides 82, 84 are seated in metallic tracks 86, which are preferably made of aluminum and mounted to the horizontal cross members 44 of the shelf frame 30, such as by a fastener in the form of a screw 85. Each aluminum track 86 includes a pair of opposing slide guide supports 88, 90. The slide guide supports 88, 90 are substantially C-shaped in cross section. Although in this second alternate embodiment the slide guide supports 88, 90 extend the full lengths of the aluminum track 86, and of each of the slide guides 82, 84, it will be recognized that the slide guide supports 88, 90 need extend over only portions of the slide guides 82, 84 in order to adequately support the slide guides 82, 84.

A cradle 92 is attached to the lower forward end 36 of the inclined shelf frame 30 and is in alignment with the container flow channel 50 defined by the slide guides 82, 84. The cradle 92 may take the form of a pair of cradle rails 94, 96 (or a single rail bent into two parallel portions) that form an L-shaped seat similar to the L-shaped seat 58 described in the first two embodiments of the invention. The cradle 92 serves to catch the lower-most container as it falls from the slide guides 82, 84, and present that container in an inviting, label-up orientation for consumer viewing. The remaining upstream containers are prevented from falling farther down the channel 50 by the lower-most container, as in the previous embodiments. Preferably, the portions of the rails 94, 96 just forward of the forward end 36 of the shelf frame 30 make an angle in a range of about 150° to 170°, and most preferably about 160°, with the slide guides 82, 84, and thus make an angle of about 70° with the front face of the lower forward end 36 of the shelf frame 30.

To accommodate relatively small sizes of cylindrical- or conical-shaped plastic tub containers, the aluminum track 86 shown in FIG. 7 has a shallow depth, e.g. in a range from about ⅛" to about ⅜", and the slide guide supports 88, 90 are spaced relatively close together, e.g. about 1½" distance between the center axes of the slide guide supports 88, 90, which is a distance that spaces the slide guides 82, 84 sufficiently far apart to avoid uncontrolled descent of the odd-shaped plastic containers down the container flow channel 50, but close enough to avoid the product falling between the slide guides 82, 84 and into contact with the aluminum track 86.

A variation of the aluminum track, to accommodate larger sized, but still odd, cylindrical- or conical-shaped plastic containers, such as larger sized multi-serving disposable yogurt tub containers, is shown in FIG. 8. This aluminum track 98 has an open U- or V-shape, with a maximum depth at its center that is deeper than the aluminum track 86 shown in FIG. 7. For example, a suitable maximum depth for the aluminum track 98 is about ⅝". The slide guide supports 100, 102 of the aluminum track 98 are also farther apart than the slide guide supports 88, 90. For example, a suitable distance between the center axes of the slide guide supports 88, 90 is about 1⅞". As in the previous embodiments, in order to avoid interference among containers in adjacent container flow channels 50, the aluminum tracks 86 or 98 should be mounted a suitable distance apart from one another, e.g. at least about 2¹⁵⁄₁₆" apart.

From the foregoing, it is believed that those skilled in the art will readily appreciate the unique features and advantages of the present invention over previous types of gravity flow shelving systems. Further, it is to be understood that while the present invention has been described in relation to particular preferred embodiments as set forth in the accompanying drawings and as above described, the same nevertheless is susceptible to change, variation, and substitution of equivalents without departure from the spirit and scope of this invention. It is therefore intended that the present invention be unrestricted by the foregoing description and drawings, except as set forth in the following appended claims.

We claim:

1. A gravity flow rack comprising one or more inclined shelf frames and a plurality of pairs of spaced rails supported by one of said inclined frames, each of said pairs of rails defining a distinct inclined channel therebetween for supporting an end-to-end array of stackable containers, said pairs of rails extending from an upper rear end of said frame to a lower forward end of the frame, and each of said pairs of rails leading to a substantially L-shaped seat associated with a single of said pairs of rails for supporting and prominently displaying a lower-most of said containers supported on said single pair of rails, said L-shaped seat being positioned forwardly of said lower forward end of the frame and being angled relative to the associated said pair of rails so as to cause said lower-most container to move to a prominent display position after descending down said inclined channel.

2. The gravity flow rack of claim 1, wherein each of said L-shaped seats is an integral extension of one of said pairs of rails.

3. The gravity flow rack of claim 1, wherein each of said L-shaped seats includes a top defined by a pair of shoulders at an increase in angle of incline of said pair of rails from the angle of incline of said frame, a back portion for supporting a rear side of a lower-most of said plurality of containers, said back portion spanning from said pair of shoulders to a pair of substantially right-angled elbows, and a bottom extending forwardly from said elbows.

4. The gravity flow rack of claim 3, wherein said bottom of said L-shaped seat terminates in a substantially vertical, upwardly extending U-shaped end of said pair of rails.

5. The gravity flow rack of claim 3, further including a shelf perimeter guard rail extending horizontally outwardly from each of a left-most and a right-most of said rails, said shelf perimeter guard rail extending above and generally parallel to an inclined plane defined by said plurality of pairs of rails, and terminating along said bases of said L-shaped seats, and said shelf perimeter guard rail preventing outward lateral movement of lower-most containers seated in said L-shaped seats of a left-most and a right-most of said inclined channels.

6. The gravity flow rack of claim 5, wherein said shelf perimeter guard rail so extends along said respective inclined channels as to further prevent outward lateral movement of at least one container positioned above said lower-most container.

7. The gravity flow rack of claim 5, wherein said frame further includes a left side wall and a right side wall, said left and right side walls each including upper wing portions that prevent outward lateral movement of containers positioned above said lower-most container in said left-most and right-most inclined channels.

8. The gravity flow rack of claim 5, further including at least one channel separator member positioned between adjacent pairs of said rails, each channel separator member comprising:

a rail extension member extending above the inclined plane defined by said pairs of rails for substantially the length of said pairs of rails;

a first leg connected to said rail extension member at an angle substantially perpendicular to said rail extension member, said first leg having first frame attachment means at a distal end thereof; and a second leg connected to said rail extension member at an angle substantially perpendicular to said rail extension member, said second leg having second frame attachment means attached thereto.

9. The gravity flow rack of claim 8, wherein each of said first and second frame attachment means comprises an arcuate clasp for securement to a horizontal cross member of said frame, said arcuate clasps adapted to cooperate to resiliently bias said channel separator between a pair of said horizontal cross members of the frame.

10. The gravity flow rack of claim 3, further including a substantially U-shaped seat perimeter guard rail extending horizontally outwardly from each of said rails at a location rearward of said pair of shoulders, said seat perimeter guard rail further extending above and generally parallel to an inclined plane defined by said plurality of pairs of rails, and terminating along said base of the L-shaped seat, said seat perimeter guard rail preventing lateral movement of said lower-most container.

11. The gravity flow rack of claim 10, wherein said seat perimeter guard rail further prevents lateral movement of at least one container positioned above said lower-most container.

12. The gravity flow rack of claim 10, further including at least one channel separator member positioned between adjacent pairs of said rails, each channel separator member comprising:

a rail extension member extending above the inclined plane defined by said pairs of rails for substantially the length of said pairs of rails;

a first leg connected to said rail extension member at an angle substantially perpendicular to said rail extension member, said first leg having first frame attachment means at a distal end thereof; and a second leg connected to said rail extension member at an angle substantially perpendicular to said rail extension member, said second leg having second frame attachment means at a distal end thereof.

13. The gravity flow rack of claim 8, wherein each of said first and second frame attachment means comprises an arcuate-shaped clasp member for securement to a horizontal cross member of said frame, said clasp members adapted to cooperate to resiliently bias said channel separator between a pair of said horizontal cross members of the frame.

14. The gravity flow rack of claim 1, wherein said angle of the L-shaped seat relative to the associated inclined pair of said rails is in a range from about 150° to about 170°.

15. The gravity flow rack of claim 14, wherein said angle is about 160°.

16. A gravity flow rack comprising one or more inclined shelf frames, a plurality of pairs of spaced slide guide rails, each of said pair of slide guide rails being supported by an associated elongated track, said track extending between a rear end and a lower forward end of said inclined shelf frame and including a pair of opposed slide guide supports adapted to receive said slide guide rails, each of said pair of slide guide rails extending between said rear end and said forward end of the inclined shelf frame and defining a distinct inclined channel therebetween for supporting an end-to-end array of stackable containers, and each of said pairs of rails leading to a substantially L-shaped seat associated with a single of said pairs of rails for supporting and prominently displaying a lower-most of said containers supported on said single pair of rails, said L-shaped seat being positioned forwardly of said lower forward end of the frame and being angled relative to the associated said pair of slide guide rails so as to cause said lower-most container to move to a prominent display position after descending down said inclined channel.

17. The gravity flow rack of claim 16, wherein said angle of the L-shaped seat relative to the associated inclined pair of said rails is in a range from about 150° to about 170°.

18. The gravity flow rack of claim 17, wherein said angle is about 160°.

19. The gravity flow rack of claim 16, wherein said track has a depth in a range of about ⅛" to about ⅜" and said slide guide supports are separated by a center-to-center distance of about 1½".

20. The gravity flow rack of claim 16, wherein said track has a maximum depth of at least about ⅝" and said slide guide supports are separated by a center-to-center distance of at least about 2 15/16".

21. The gravity flow rack of claim 1, wherein each of said containers is of a generally conical shape.

22. The gravity flow rack of claim 21, wherein said conical shaped containers are supported in an orientation wherein a back side of each container rests in one of said inclined channels.

* * * * *